US009222440B2

(12) United States Patent
Chen et al.

(10) Patent No.: US 9,222,440 B2
(45) Date of Patent: Dec. 29, 2015

(54) ONE-STEP STARTING CARBURETOR

(71) Applicant: Qian Chen, Ruian (CN)

(72) Inventors: Qian Chen, Ruian (CN); Yongcheng Jia, Ruian (CN)

(73) Assignee: Qian Chen, Ruian (CN)

( * ) Notice: Subject to any disclaimer, the term of this patent is extended or adjusted under 35 U.S.C. 154(b) by 208 days.

(21) Appl. No.: 13/862,675

(22) Filed: Apr. 15, 2013

(65) Prior Publication Data

US 2014/0196688 A1 Jul. 17, 2014

(30) Foreign Application Priority Data

Jan. 15, 2013 (CN) ..... 2013 1 0013863

(51) Int. Cl.

| | |
|---|---|
| ***F02M 7/00*** | (2006.01) |
| ***F02M 1/08*** | (2006.01) |
| ***F02M 1/10*** | (2006.01) |
| ***F02M 7/087*** | (2006.01) |
| ***F02M 17/04*** | (2006.01) |
| ***F02M 1/16*** | (2006.01) |
| ***F02M 7/08*** | (2006.01) |

(52) U.S. Cl.

CPC . *F02M 1/08* (2013.01); *F02M 1/10* (2013.01); *F02M 1/16* (2013.01); *F02M 7/00* (2013.01); *F02M 7/08* (2013.01); *F02M 7/083* (2013.01); *F02M 7/087* (2013.01); *F02M 17/04* (2013.01)

(58) Field of Classification Search

CPC ..... F02M 1/08; F02M 1/10; F02M 1/16; F02M 7/00; F02M 7/08; F02M 7/087; F02M 17/142; F02M 17/145; F02M 17/147; F02M 37/08; F02M 7/14

USPC ..... 123/437, 438, 179.9, 406.56, 497, 498, 123/509, 510, 512, 514, 599, 685, 701, 123/179.19, 179.29; 417/415, 420, 470, 417/476, 494

See application file for complete search history.

(56) References Cited

U.S. PATENT DOCUMENTS

| | | | | |
|---|---|---|---|---|
| 3,942,494 | A * | 3/1976 | Toda et al. | 123/445 |
| 4,207,773 | A * | 6/1980 | Stahovic | 74/25 |
| 4,291,860 | A * | 9/1981 | Bauer | 251/129.02 |
| 4,986,229 | A * | 1/1991 | Suzuki et al. | 123/179.16 |
| 5,315,968 | A * | 5/1994 | Niebrzydoski | 123/73 C |
| 5,365,893 | A * | 11/1994 | Wissmann et al. | 123/73 C |
| 5,398,654 | A * | 3/1995 | Niebrzydoski | 123/445 |
| 7,261,280 | B2 | 8/2007 | Takano | |
| 8,950,381 | B2 * | 2/2015 | Larsson et al. | 123/490 |
| 2002/0135082 | A1 * | 9/2002 | Woody | 261/35 |
| 2010/0196179 | A1 * | 8/2010 | Noguchi | 417/415 |

FOREIGN PATENT DOCUMENTS

| | | |
|---|---|---|
| CN | 2639541 Y | 9/2004 |
| CN | 1869425 A | 11/2006 |

* cited by examiner

*Primary Examiner* — Stephen K Cronin
*Assistant Examiner* — Kevin R Steckbauer
(74) *Attorney, Agent, or Firm* — Caesar Rivise, PC

(57) ABSTRACT

A one-step starting carburetor system includes a body, a middle body, a fuel inlet pipe, a fuel outlet pipe, a lower cover and a temperature controller which is connected to the lower cover. The fuel inlet pipe pumps fuel from an oiler through the pipe. The fuel outlet pipe connects with an oil pumping unit through a pipe. The body connects with a pulse generator through a pipe, wherein the pulse generator comprises a pulse generating chamber, a cover, and a solenoid valve.

21 Claims, 10 Drawing Sheets

ONE-STEP STARTING CARBURETOR

TECHNICAL FIELD

The embodiments described herein relate to a carburetor, more particularly to a one-step starting carburetor.

BACKGROUND OF THE INVENTION

The continuing improvements of society and economic have provided a good platform for further development of the gasoline engine industry. Hereinto the gasoline engine auxiliary industry has developed rapidly because of the development of the gasoline engine industry. As one of the gasoline engine auxiliary industries, the carburetor industry developed rapidly.

A carburetor is an apparatus which mixes certain amount of fuel and air in order to make the petrol engine operate regularly. In the start-up process of an engine, the amount of air is reduced and the density of mixture gas into the engine is increased by closing the induction passage, so that the engine starts. However, existing carburetors have certain drawbacks. Before those carburetors leave factories, the indicator which adjusts the amount of fuel supplying of main oil-support installations and idling oil-support installations is adjusted. Therefore, the carburetor supplies petrol to the engine at an ideal proportion of air and fuel mixture to reach the optimal and most efficient engine working mode to save energy. In order to improve the start-up possibility and reduce the times of starting of the engine, it should remain in a high density of fuel and air mixture in the carburetor. After the start-up process is finished, the carburetor works in a normal condition, and it should reach the optimal proportion in order to perform well, extend the working life and reduce air pollution. However, existing carburetors cannot fulfill the mentioned requirements.

China patent application number 03233510.5 discloses a carburetor. A manual crowding valve and a manual crowding valve manipulator are installed on the body of said carburetor, and a crowding valve inlet pipe and a mixed oil and gas vent are installed on the body. The crowding valve inlet pipe is connected with the manual crowding valve at an inlet vent of the carburetor. The mixed oil and gas vent is connected with the inside of a restrictor of the carburetor by the manual crowding valve. At the same time the inlet vent of the carburetor is also installed on a vacuum valve inlet vent of the carburetor. An auxiliary inlet device is installed on the crowding valve and connected with the crowding valve inlet pipe from the vacuum valve inlet vent of the carburetor. Installing a simple auxiliary inlet device makes up for a weakness of small size of the crowding valve inlet pipe and increases the mixed oil and gas quantity of the crowding valve. A cold starting problem which is caused by an original carburetor with a smaller displacement used on an engine with a larger displacement is solved. But the manual crowding valve is used by such carburetor to add the concentration of the mixing gas. The accuracy is not enough. It could not guarantee to generate enough pulse in the pulse chamber of the carburetor to drive the carburetor work, and it is not convenient to control.

An engine's starting apparatus of the rotary valve carburetor which drives the cam's interface connectors through the actuating lever's rotation, and then the starting apparatus causes the throttle lever to rotate around the rotation axis and axially lift from the carburetor partially with a predetermined angle and the axial distance, as disclosed in China Patent No. CN200610008981.X. The engine starting apparatus thereafter provides a controllable and concentrated fuel-air mixture for the engine's start up, but the carburetor requires cam interface shifter which drives the throttle lever move in the axial direction. Therefore this kind of carburetor demands complex structural design, increases the axial dimension and hinders its applications.

In existing technologies, the oil pumping ball of the carburetor needs to be pressed by hand before starting up the engine. Firstly the air in the carburetor is exhausted, and then the fuel in the oiler is pumped into the carburetor. The choke valve should be closed before starting up. When poop-poop sound is made, the choke valve needs to be opened half to warm the engine after pulling the starting line, and then the choke valve should be opened fully after warming the engine. These operations are complicated and it is not easy to operate. Thus it is desirable to provide a carburetor whose operations are simple without pumping the oil manually and closing and opening the choke valve, and it only needs to pull the starting line simply.

SUMMARY OF THE INVENTION

Based on the above mentioned problems, the present invention provides a one-step starting carburetor to solve the problems that it needs to extrude the oil pumping ball to pump the fuel for the carburetor, and it needs to close a choke valve, after hearing the sound like 'poop-poop', furthermore choke valve needs to be half opened to warm the engine and to open the choke valve after warming the engine. Thus these operations are complicated and affect the normal work of the engine. In order to achieve the above objects, the technical solution of the present invention provides:

A one-step starting carburetor comprising:

a body, a middle body, a fuel inlet pipe, a fuel outlet pipe, a lower cover and a temperature controller which is connected with the lower cover.

Wherein the fuel inlet pipe pumps fuel from an oiler through a pipe, and the fuel outlet pipe connects with an oil pumping unit through a pipe;

the body connects with a pulse generator through a pipe.

Preferably, the body includes a pulse chamber, a main nozzle and a mixing chamber.

Preferably, the middle body includes the lower cover, a metering chamber and a metering diaphragm which is in the metering chamber.

Preferably, the temperature controller includes a copper base, paraffin, a diaphragm, fluid medium, a plunger, a top pole, an air vent and a return spring.

Preferably, the oil pumping unit and the pulse generator are both put up along a magneto of an engine.

Preferably, the oil pumping unit is a valve structure oil pumping unit or a diaphragm type oil pumping unit.

Preferably, a flywheel is put up on the magneto, and the pulse chamber of the pulse generator inhales and exhales when the flywheel is operating.

Preferably, two magnets are put up on the flywheel and N pole of one magnet is outward and S pole of another magnet is outward.

Preferably, one magnet is put up on the pulse generator.

Preferably, the magnets of the flywheel and the magnet of the pulse generator attract or repel each other when the flywheel is operating.

Preferably, the pulse chamber inhales when the magnets of the flywheel and the magnet of the pulse generator attract each other.

Preferably, the pulse chamber exhales when the magnets of the flywheel and the magnet of the pulse generator repel each other.

Preferably, the inhalation and exhalation are generated by the magnets of the flywheel and the magnet of the pulse generator, a part of fuel enters into the pulse chamber of the carburetor through a normal pulse pipe, and then pumping force is generated by a diaphragm of the pulse chamber to pump the fuel from the oiler to the carburetor to provide continuous fuel for the carburetor.

Preferably, of the inhalation and exhalation which are generated by the magnets of the flywheel and the magnet of the pulse generator, only the exhalation pulse can enter into a chamber with the lower cover of the carburetor through a crowding pipe due to the one-way valve, more fuel is sprayed out from the main nozzle of the carburetor by pushing the metering diaphragm when a solenoid valve is open, and mixed gas is concentrated in the mixing chamber to start the engine easily.

Preferably, the valve structure oil pumping unit includes a magnet.

Preferably, the magnets of the flywheel and the magnet of the valve structure oil pumping unit attract or repel each other when the flywheel is operating.

Preferably, an inhalation pulse is generated by an oil pumping chamber when the magnets of the flywheel and the magnet of the valve structure oil pumping unit attract each other, an umbrella shaped surface A of the valve core departs the plane of support to inhale the fuel from the oiler to the carburetor.

Preferably, an exhalation pulse is generated by an oil pumping chamber when the magnets of the flywheel repel the magnet of the valve structure oil pumping unit, and an umbrella shaped surface A of the valve core fits and seals with the support plane, so the fuel in the oil pumping chamber can't return to the carburetor through the valve, and the valve core plays a role of a one-way valve, and the fuel flows back to the oiler through the valve B.

Preferably, the diaphragm type oil pumping unit includes a magnet.

Preferably, the magnets of the flywheel and the magnet of the diaphragm type oil pumping unit attract or repel each other when the flywheel is operating.

Preferably, the chamber on the support of the oil pumping unit inhales when the magnets of the flywheel and the magnet of the diaphragm type oil pumping unit attract each other.

Preferably, the chamber on the support of the oil pumping unit exhales when the magnets of the flywheel and the magnet of the diaphragm type oil pumping unit repel each other.

Preferably, of the inhalation and exhalation which are generated by the magnets of the flywheel and the magnet of the diaphragm type oil pumping unit, the suction is produced in the diaphragm type oil pumping unit under repeated application of the inhalation pulses and the exhalation pulses, and the fuel in the oiler is pumped into the carburetor through the pipe by the suction, and then redundant fuel in the carburetor flows back to the oiler through the pipe.

Compared with existing technologies the carburetor described herein is connected with the pulse generator and the oil pumping unit through the pipe line. When the engine starts at low temperature, the air vent on the temperature controller is in a closed state. There are two types of pulse generated by the pulse generator: the crowding pulse and the normal pulse. The crowding pulse enters into the chamber with the lower cover of the metering chamber of the carburetor. The metering diaphragm is pushed by such crowding pulse and the fuel in the metering chamber is squeezed into the body. The fuel-air mixture in the mixing chamber of the body is concentrated. Thus the engine would start easily. When the engine starts at high temperature, the air vent on the temperature controller is in an open state. Even though the crowding pulse was into a chamber with the lower cover of the metering chamber of the carburetor after the engine starting, the crowding pulse would be discharged to the outside of the lower cover of the carburetor through the air vent on the temperature controller. The metering diaphragm could not be pushed by the pulse force, thus the fuel-air mixture in the mixing chamber in the carburetor would not be concentrated. At high temperature the engine does not need much concentrated fuel-air mixture so that it nicely meets the requirement of the engine's starting up. The normal pulse enters into the pulse chamber of carburetor to provide pumping force in the normal working mode of carburetor. Therefore, the present invention improves the engine's performance and further increases the engine's life-span while reducing the fuel consumption.

BRIEF DESCRIPTION OF THE DRAWINGS

There are some specific embodiments based on the present invention. Features and advantages of the present invention will become apparent on the following descriptions in detail.

DESCRIPTION OF A SPECIFIC EMBODIMENT

The following descriptions are only exemplary embodiments and not intended to limit the present disclosure, applications, or uses. It should be understood that, in all the drawings, the corresponding number denotes the same or corresponding part and feature. Two embodiments are described below with reference to the drawings.

Embodiment One

Figure 1:
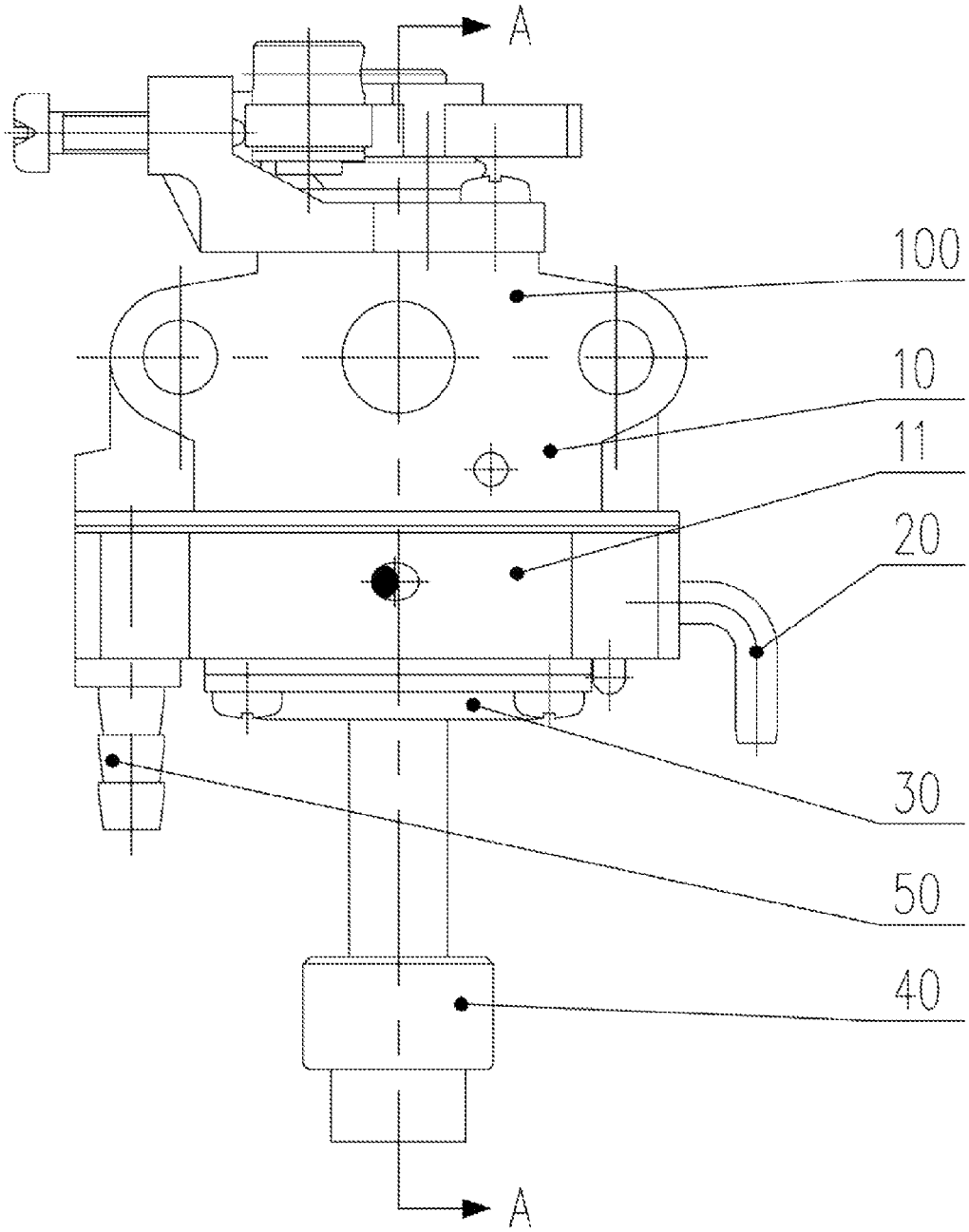
FIG. 1 is a structural schematic diagram of the present invention carburetor.
Figure 2:
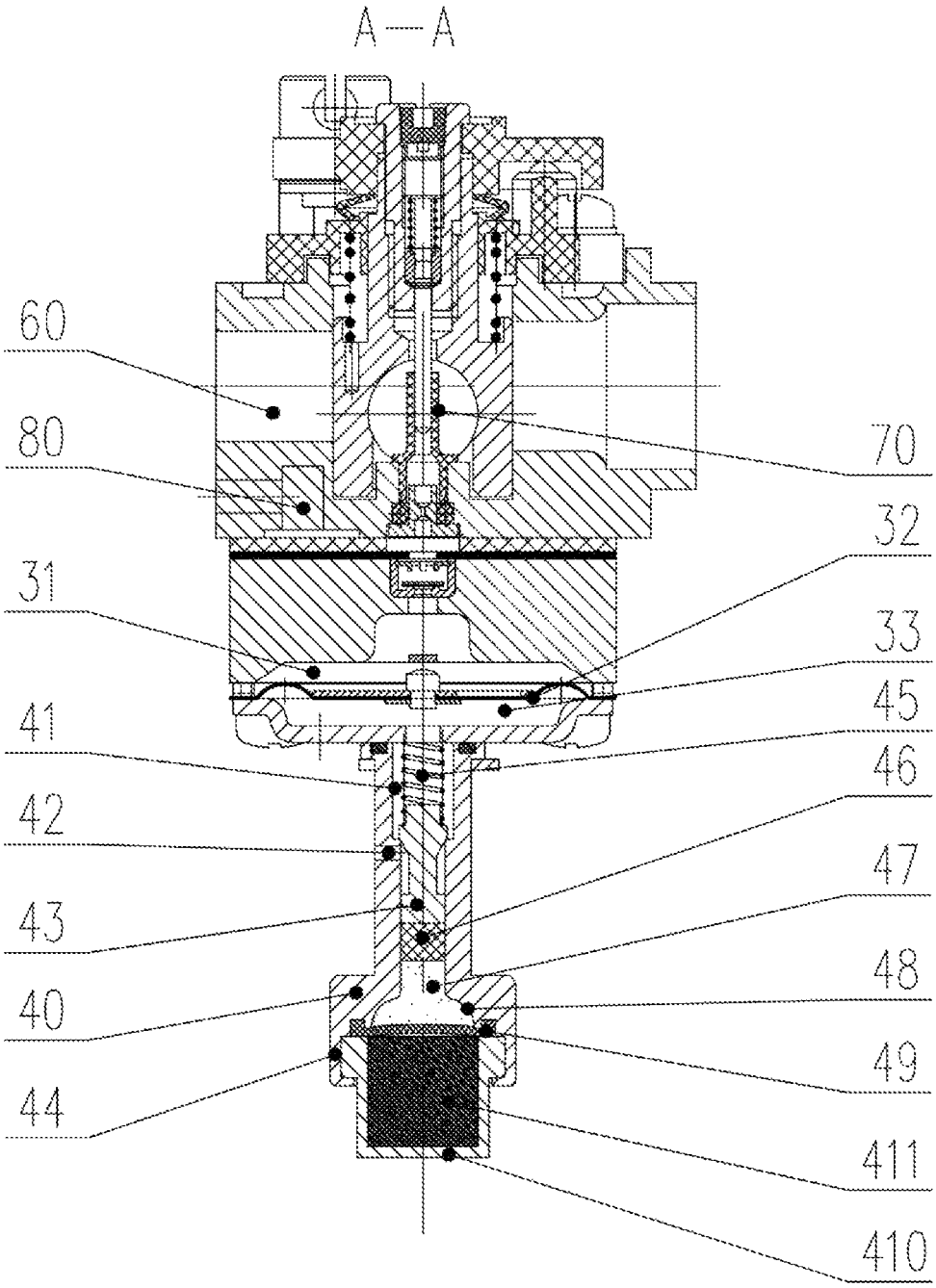
FIG. 2 is a sectional view of A-A direction of the carburetor in FIG. 1.

Now refers to the drawings, FIG. 1-2 describe an embodiment according to the overall structure of the one-step starting carburetor 100 of the present invention. As shown in the FIG. 1 that the carburetor 100 has a body 10, a middle body 11, a fuel inlet pipe 50, a fuel outlet pipe 20, a lower cover 30 and a temperature controller 40 which is connected with the lower cover 30. The body 10 includes a pulse chamber 80, a main nozzle 70 and a mixing chamber 60. The middle body 11 includes the lower cover 30, a metering chamber 31 and a metering diaphragm 32 which is in the metering chamber 31 and a chamber 33 of the lower cover. The temperature controller 40 includes a copper base 410, paraffin 411, a diaphragm 49, a fluid medium 47, a plunger 46, a top pole 43, an air vent 42 and a return spring 45.

Further according to FIG. 2, the temperature controller 40 herein is described in detail. The section of copper base 410, in which the paraffin 411 is placed, is in a rectangle shape with steps. The housing 44 has a chamber extended in the lower part. The housing 44 is connected with the copper base 410 by means of, for example, a threaded connection or rivet joint, so that the copper base 410 is fixed on the housing 44. The housing 44 has a hollow chamber for the top pole 43 and a chamber for fluid medium 47 which is located below the housing 44. The section of the fluid medium chamber 48 is flared horn-shaped to hold the fluid medium 47. The fluid medium 47 of the present invention is a high density fluid-like substance which is also not easy to dry. In the exemplary embodiment, the fluid medium 47 of the present invention is a mixture of $MoS_2$ powder and grease. Diaphragm 49 is set between fluid medium 47 and paraffin 411. The plunger 46 which is slidable along the hollow chamber 41 is set above fluid medium 47. The movable top pole 43 is set in the hollow chamber 41 which is located in the housing 44. The top pole 43 is comprised of an elongate part, the inverted arrow-shaped protrusion and the tail, and the diameter of the elongate part is shorter than the minimum diameter of the hollow chamber 41 so that air from the vent 42 can enter into the hollow chamber 41. While the outside temperature is lower than 20° C., the inverted arrow-shaped protrusion of the top pole 43 abuts against the shoulder seat of the housing 44 through the pre-biasing force of the return spring 45, so that the channel connecting the metering chamber 31 with the hollow chamber 41 is closed. One end of the return spring 45 is connected to the tail of the top pole 43, and the other end of the return spring 45 is fixed in the lower cover 30, so the return spring 45 can be axially compressed with the movement of the top pole 43.

Paraffin 411 that is placed in the temperature controller 40 works as a temperature sensor component. The character of thermal expansion and contraction of paraffin 411 is utilized to move the top pole 43. Therefore the inverted arrow-shaped protrusion of the top pole 43 opens or closes the channel connecting the metering chamber 31 with the vent 42; furthermore the fuel extruded from the main nozzle 70 in the metering chamber can be controlled when the engine is starting up. The top pole 43 of the temperature controller 40 of present invention is closed when the temperature is lower than the first temperature threshold value, whereas the top pole 43 opens when the temperature is higher than the second temperature threshold value. In the exemplary embodiment, the first temperature threshold value of the present invention is set for example 20° C., while the second temperature threshold value is set for example 38° C. The first and second temperature threshold value of the present invention can vary with each application of the engine, for example the first temperature threshold value can be set between 18° C. to 25° C., and the second temperature threshold value can be set between 35° C. to 42° C.

Figure 3:
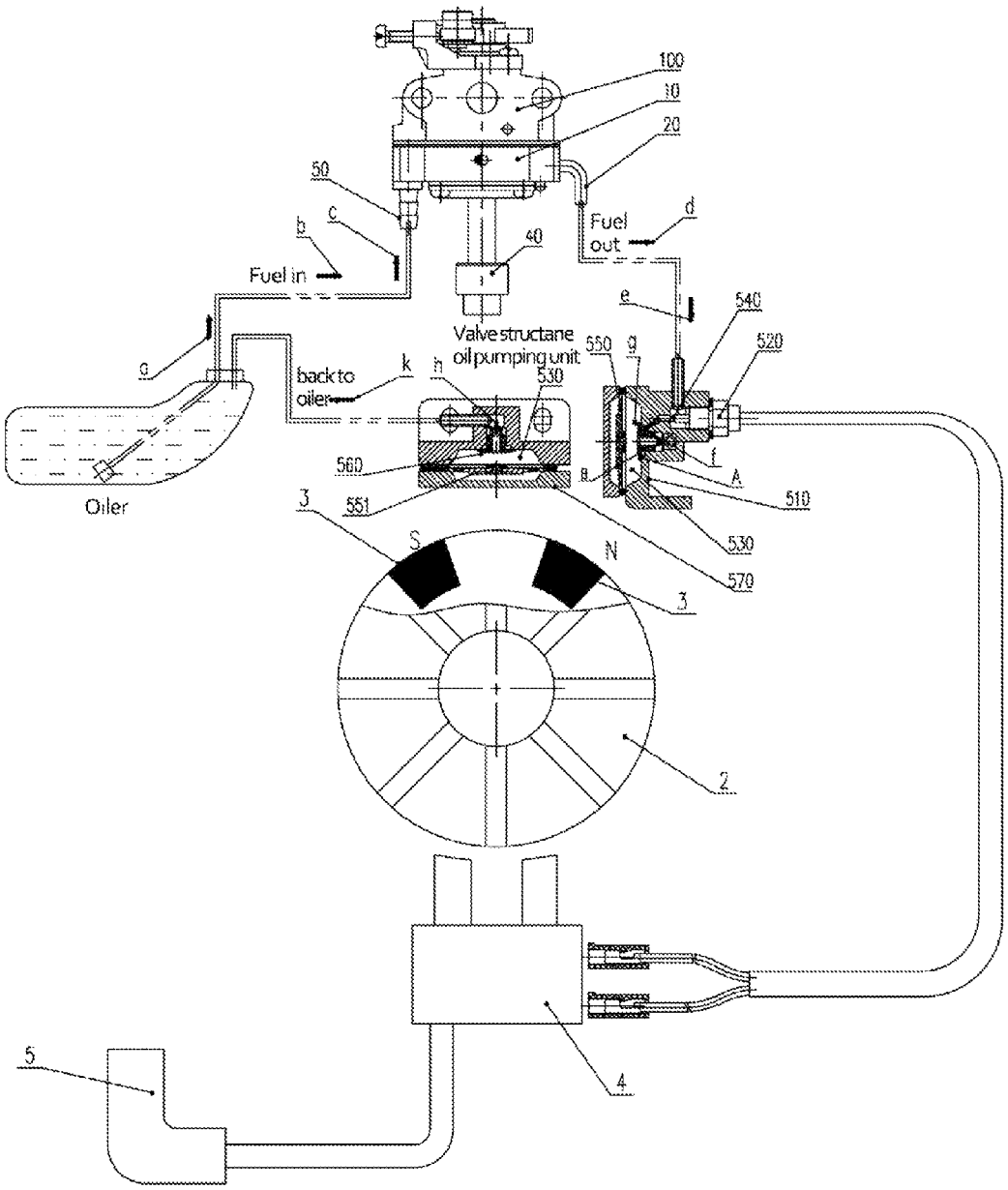
FIG. 3 is a structural schematic diagram of the combination of the valve structure oil pumping unit and the carburetor in FIG. 1.
Figure 10:
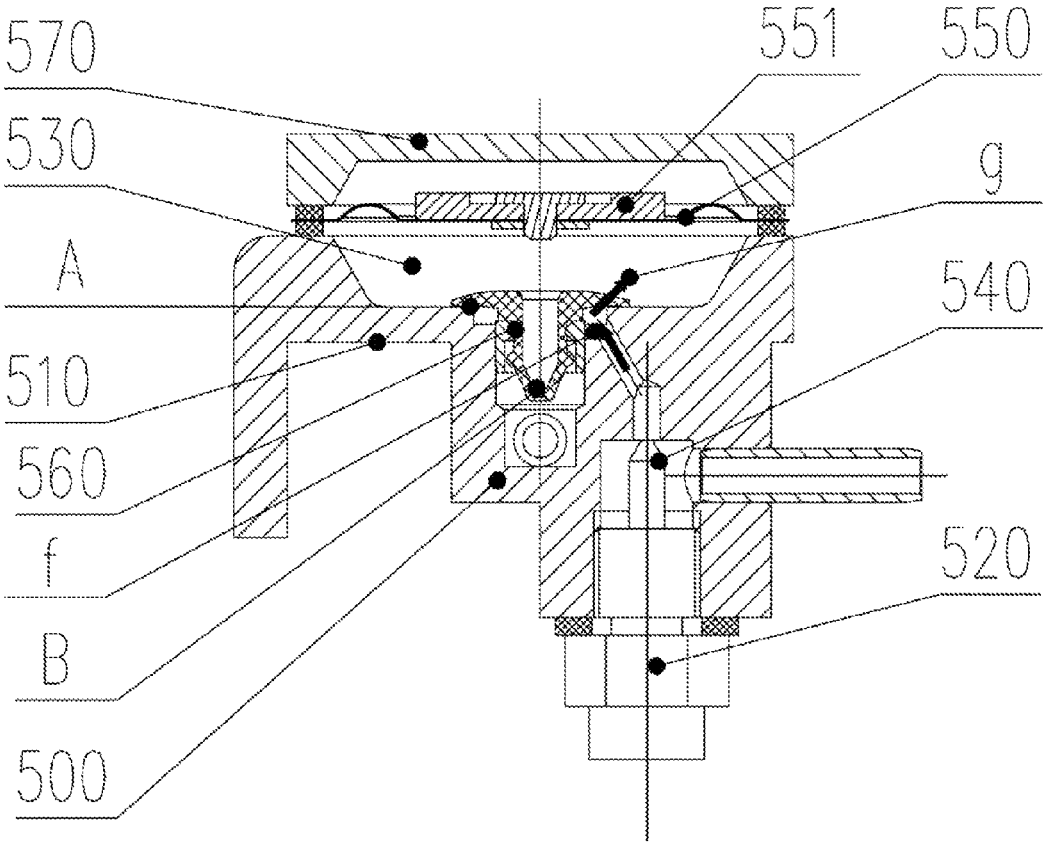
FIG. 10 is a sectional view of the valve structure oil pumping unit in FIG. 3.

Turning to FIGS. 3 and 10, FIG. 10 is a structure diagram of a valve structure oil pumping unit 500. The valve structure oil pumping unit 500 includes a support 510, a valve core 560, an oil pumping chamber 530, a solenoid valve 520 and a lower cover 570. The oil pumping chamber 530 includes a diaphragm 550 and a magnet 551. The magnet 551 is installed on the diaphragm 550. A valve 540 is installed on the top of the solenoid valve 520. The oil pumping chamber 530 is a groove on the top of the support 510. The redundant fuel in the carburetor 100 flows through the fuel outlet pipe 20 (refers to the drawings FIG. 1-3), and then the redundant fuel goes into the oil pumping chamber 530 through the pipe and flows back to the oiler finally. The valve core 560 is set at the central position of the support 510. When the oil pumping chamber produces suction, the umbrella shaped surface A of the valve core 560 leaves the plane of the support 510. When the fuel flows into the valve core 560, the fuel flows from the umbrella shaped surface A of the valve core 560 that is the g (refers to FIG. 3), then eventually flows to the oiler through an open B of valve core 560. When the oil pumping chamber exhales, the umbrella-shaped surface A of the valve core 560 fits and seals the plane of the support 510. The fuel in the oil pumping chamber can flow one way only instead of a return journey, and the valve core 560 plays a role of a one-way valve.

Further according to the FIG. 3, FIG. 3 is a structural diagram of a combination of the valve structure oil pumping unit 500 and the carburetor 100 herein. The oil inlet (unmarked) of the valve structure oil pumping unit 500 is connected with the fuel outlet pipe 20 of the carburetor 100 through a pipeline. The oil outlet (unmarked) of the valve structure oil pumping unit 500 is connected with the oiler through a pipeline.

With the help of FIGS. 1 and 3, the working process of the valve structure oil pumping unit 500 herein is described in detail. When the engine is starting, the flywheel 2 of the engine revolves. The magnets 3 of the flywheel 2 and the magnet 551 of the diaphragm 550 attract or repel each other to lead the diaphragm 550 to move up and down. When the diaphragm 550 moves up and down, the oil pumping chamber 530 would inhale and exhale. When the magnets 3 of the flywheel 2 and the magnet 551 of the diaphragm 550 attract each other, the oil pumping chamber 530 would inhale. At this time the fuel in the oiler can be through pipe lines according to the order of a, b and c into the fuel inlet pipe 50 and then flow into the main body of the carburetor 100. The redundant fuel flows into a valve hole (unmarked) of the valve core 560 through fuel outlet pipe 20 and pipe lines according to the order of d and e followed by the oil inlet of the valve structure oil pumping unit 500 (not marked) and the valve 540. When the magnets 3 of the flywheel 2 and the magnet 551 of the diaphragm 550 attract each other, the umbrella-shaped surface A of the valve core 560 leaves the plane of the support 510. The fuel that is in the valve hole of the valve core 560 flows into the oil pumping chamber 530 according to the order off and g to pump the fuel for the oil pumping unit 100. When the magnets 3 of the flywheel 2 and the magnet 551 of the diaphragm 550 repel each other, the exhalation pulse is generated in the oil pumping chamber 530. At this time the umbrella-shaped surface A of the valve core 560 fits and seals an internal plane of the oil pumping chamber 530. Thus the fuel cannot return to the carburetor 100 through the valve 540. The fuel only flows from a hole B of the valve core 560 and finally according to the order of h and k flows into the oiler.

When the engine's rotational speed is faster than 2000 r/min after starting the engine, a spark plug 5 is ignited. A CPU control system of an igniter 4 on the spark plug 5 transfers signals to the solenoid valve 520 of the valve structure oil pumping unit 500. The solenoid valve 520 is opened. An oil circuit from the carburetor 100 to the valve structure oil pumping unit 500 is closed. At this time even if the diaphragm 550 on the valve structure oil pumping unit 500 still moves up and down, the valve structure oil pumping unit 500 cannot pump the fuel from the carburetor 100. Thus it could not affect the carburetor 100 normally working.

Turning to FIGS. 1, 2, 5 and 8, the working process of the pulse generator 200 herein is described in detail. The pulse generator 200 includes a pulse generating chamber 201, a lower cover 204, a support 206 and a solenoid valve 208. The pulse generating chamber 201 is a concave groove which is dug at an internal central position of the support 206. A diaphragm 205 is set up in the pulse generating chamber 201. A magnet 207 is installed on the diaphragm 205. A one-way valve 202 is set at the outlet of a valve 203. This one-way valve 202 guarantees that in the suction process the inhaled pulse could not be pushed into the chamber 33 of the lower cover of the metering chamber of the carburetor 100.

When the engine is starting, the flywheel 2 of the engine revolves. The magnets 3 of the flywheel 2 and the magnet 207 of the diaphragm 205 attract or repel each other to lead the diaphragm 205 to move up and down. When the diaphragm 205 moves up and down, the pulse generating chamber 201 will inhale and exhale. The pulse chamber 80 of the carburetor 100 is connected with the pulse generating chamber 201 by the pipe 1. The pulse into the pulse chamber 80, as a pumping force of the normal work of the carburetor 100, constantly provides fuel for the carburetor 100.

The pulse generator 200 generates two types of pulse in work process: normal pulse and crowding pulse. When the engine starts in cold, the solenoid valve is not plugged. The solenoid valve 208 is in an open state. The pulse in the pulse generating chamber 201 is into a chamber 33 of the lower cover of the metering chamber of the carburetor 100. The metering diaphragm 32 is pushed by the pulse force and the fuel in the metering chamber 31 from the oil pumping unit is pushed into the main nozzle 70 of the carburetor 100. The fuel-air mixture in the mixing chamber 60 is concentrated. Thus the engine's starting performance is greatly improved. A spark plug 5 is ignited after starting the engine. A CPU control system of an igniter 4 on the spark plug 5 transfers signals to the solenoid valve 208. The solenoid valve 208 is opened. At the same time the valve 203 is closed. Thus no pulse force is into a chamber 33 of the lower cover of the metering chamber of the carburetor 100. Another normal pulse generated by the pulse generator 200 goes into the pulse chamber 80 of the carburetor 100 to provide the oil pumping force for the normal work of the carburetor.

Figure 6:
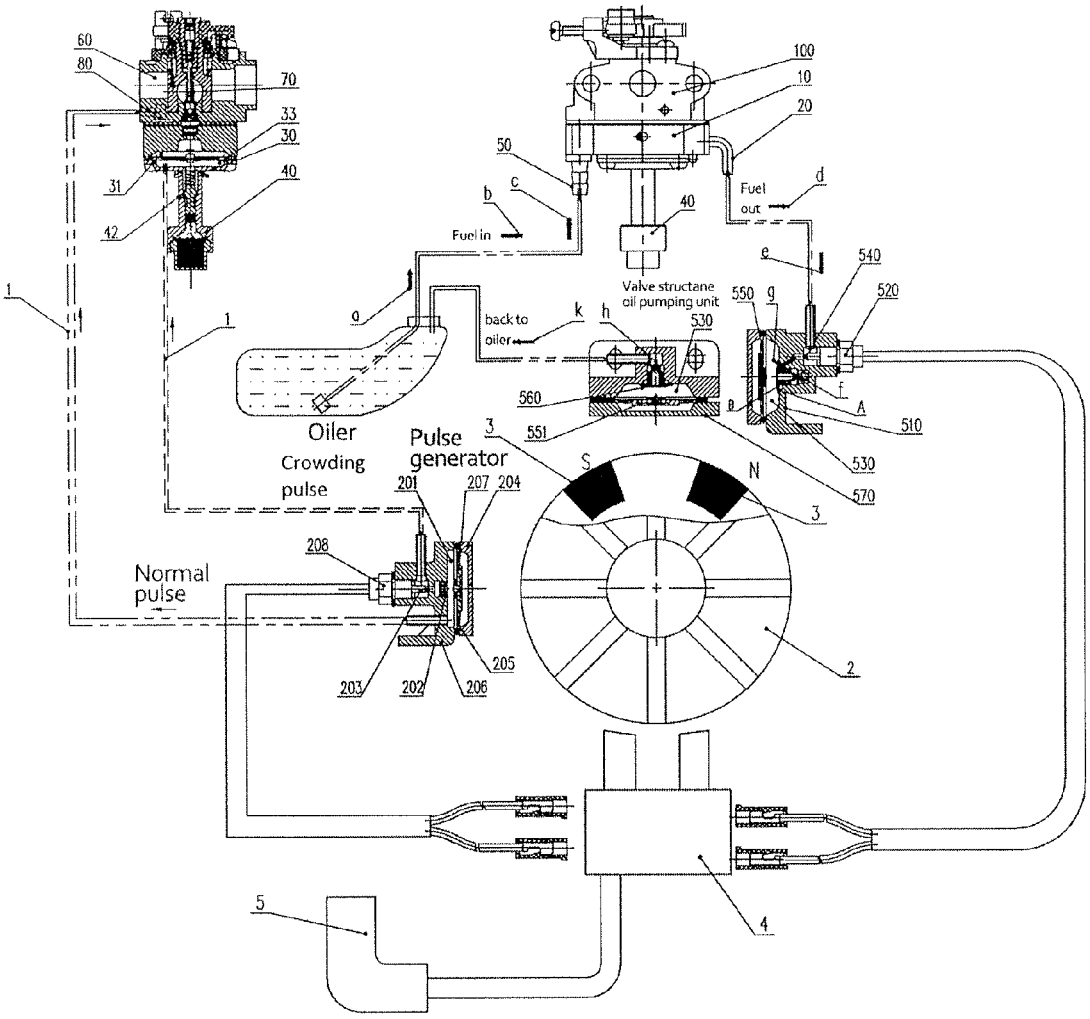
FIG. 6 is a structural schematic diagram of the combination of the pulse generator, the valve structure oil pumping unit and the carburetor in FIG. 1.

Further according to the FIG. 6, FIG. 6 is a structural diagram of a combination of the pulse generator 200, the valve structure oil pumping unit 500 and the carburetor 100 herein. Turning to FIGS. 2 and 6, the working process of the carburetor 100 which is connected with the pulse generator 200 and the valve structure oil pumping unit 500 herein is described in detail.

When the engine is starting, the flywheel 2 of the engine revolves. The magnets 3 of the flywheel 2 and the magnet 551 of the diaphragm 550 attract or repel each other to lead to the diaphragm 550 move up and down. When the diaphragm 550 moves up and down, the oil pumping chamber 530 will inhale and exhale. When the magnets 3 of the flywheel 2 and the magnet 551 of the diaphragm 550 attract each other, the oil pumping chamber 530 will inhale. At this time the fuel in the oiler can be through pipe lines according to the order of a, b and c and flows into the main body of the carburetor 100 by the fuel inlet pipe 50. The redundant fuel flows into a valve hole (not marked) of the valve core 560 through fuel outlet pipe 20 and pipe lines according to the order of d and e followed by the oil inlet of the valve structure oil pumping unit 500 (not marked) and the valve 540. When the magnets 3 of the flywheel 2 and the magnet 551 of the diaphragm 550 attract each other, the umbrella-shaped surface A of the valve core 560 leaves the plane of the support 510. The fuel that is in the valve hole of the valve core 560 flows into the oil pumping chamber 530 according to the order off and g to pump the fuel for the oil pumping unit 100. When the magnets 3 of the flywheel 2 and the magnet 551 of the diaphragm 550 repel each other, the exhalation pulse is generated in the oil pumping chamber 530. At this time the umbrella-shaped surface A of the valve core 560 fits and seals an internal plane of the oil pumping chamber 530. Thus the fuel cannot return to the carburetor 100 through the valve 540. The fuel only flows from a hole B of the valve core 560 and finally according to the order of h and k flows into the oiler.

When the engine's rotational speed is faster than 2000 r/min after starting the engine, a spark plug 5 is ignited. A CPU control system of an igniter 4 on the spark plug 5 transfers signals to the solenoid valve 520 of the valve structure oil pumping unit 500. The solenoid valve 520 is opened. An oil circuit from the carburetor 100 to the valve structure oil pumping unit 500 is closed. At this time even if the diaphragm 550 on the valve structure oil pumping unit 500 still moves up and down, the valve structure oil pumping unit 500 cannot pump the fuel from the carburetor 100. Thus it could not affect the carburetor 100 normally working.

When the engine starts at low temperature, or, more accurately, when the environment temperature is lower than 20° C., the air vent 42 on the temperature controller 40 is in a closed state. The pulse is produced in the pulse generating chamber 201 of the pulse generator 200. A part of the crowding pulse is into the chamber 33 of the lower cover of the metering chamber 31 of the carburetor 100. The metering diaphragm 32 is pushed by such crowding pulse, and the fuel in the metering chamber 31 from the valve structure oil pumping unit 500 is squeezed into the main nozzle 70. The fuel-air mixture in the mixing chamber 60 is concentrated. Thus the engine would start easily. When the engine is starting and running after 3-5 seconds, the crowding pulse would be cut off by the solenoid valve 208. The crowding pulse could not enter into the chamber 33 of the lower cover of the metering chamber 31 of the carburetor 100, and the fuel-air mixture in the mixing chamber 60 could not be concentrated. Thus the normal work of the carburetor 100 would not be affected.

When the environment temperature is higher than 38° C., the air vent 42 on the temperature controller 40 is in an open state. Even the crowding pulse is into the chamber 33 of the lower cover of the metering chamber 31 of the carburetor 100 after the engine starting, the crowding pulse is discharged to the outside of the lower cover 30 of the carburetor 100 through the air vent 42 on the temperature controller 40. The metering diaphragm 32 could not be pushed by the pulse force. Thus the fuel-air mixture in the mixing chamber 60 in the carburetor 100 could not be concentrated. At the high temperature the engine also does not need too thick fuel-air mixture just to meet the requirement of the engine starting. The pulse produced by the pulse generator 200 goes into the chamber pulse chamber 80 of the carburetor 100 through the normal pulse pipe to provide the oil pumping power for the normal work of the carburetor 100. When the engine is starting and running after 3-5 seconds, the crowding pulse would be cut off by the solenoid valve 208. The crowding pulse could not enter into the chamber 33 of the lower cover of the metering chamber 31 of the carburetor 100 and the fuel-air mixture in the mixing chamber 60 could not be concentrated. Thus the normal work of the carburetor 100 would not be affected.

Embodiment Two

Figure 9:
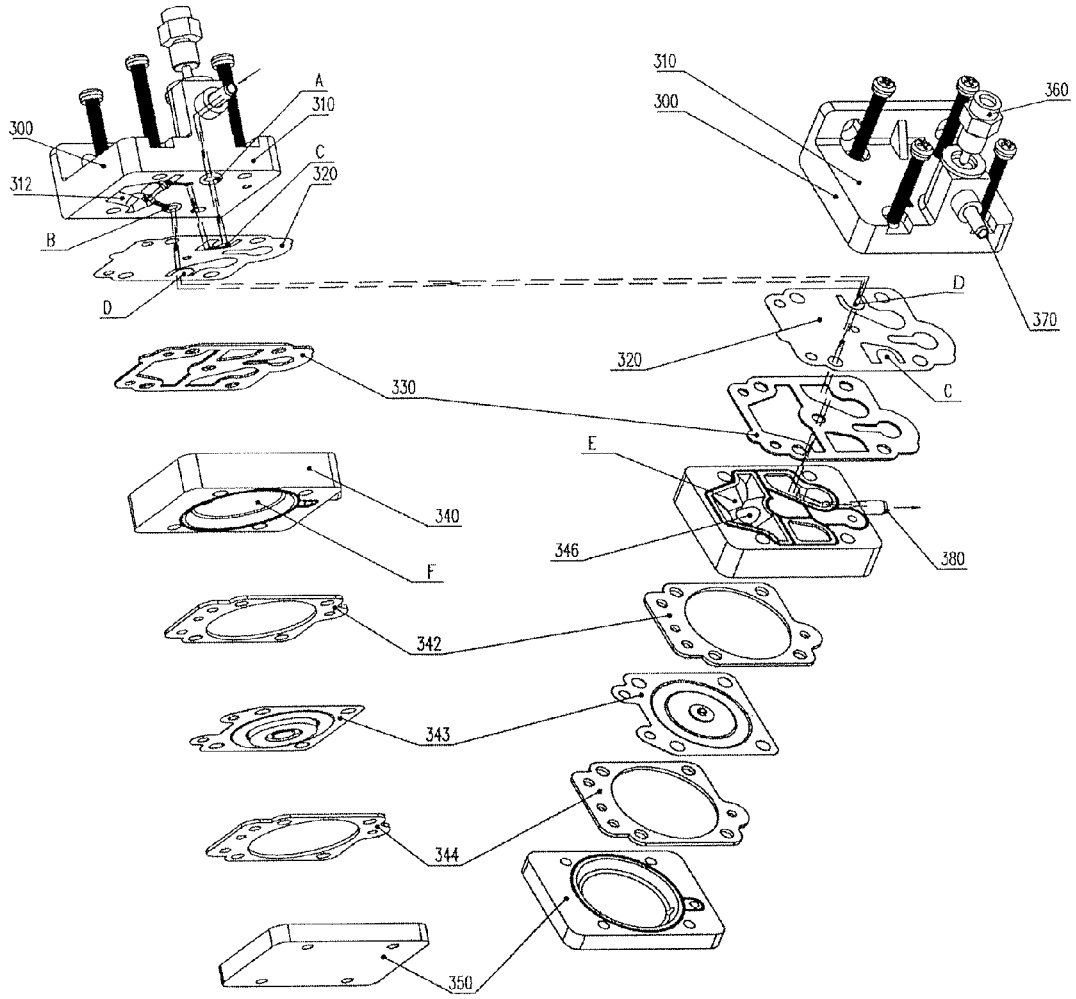
FIG. 9 is an exploded view of the diaphragm type oil pumping unit in FIG. 4.

Now referring to the drawings 4 and 9, FIG. 9 is an exploded view of the diaphragm type oil pumping unit 300.

The diaphragm type oil pumping unit 300 includes a support 310, a middle body 340 and a lower cover 350. The support 310 is connected with the middle body 340 and the lower cover 350 by bolts. A fuel inlet pipe 370, a solenoid valve 360 and a fuel outlet pipe 380 are set up on the support 310. A chamber 312, a plane A and a plane B are set up at the bottom of the support 310. A pulse chamber E and a small hole 346 are set up in the upper part of the middle body 340, and a pulse chamber F is set up at the bottom of the middle body 340. An oil pumping diaphragm 320 and a sealing gasket 330 are set up between the middle body 340 and the support 310. A tongue piece C and a tongue piece D are set up on the oil pumping diaphragm 320. A lower sealing gasket 342, a diaphragm part 343 and a lower sealing gasket 344 are set up between the middle body 340 and the lower cover 350. A magnet 351 is set up on the diaphragm part 343 and is located in a groove (not marked) of the lower cover 350.

Figure 4:
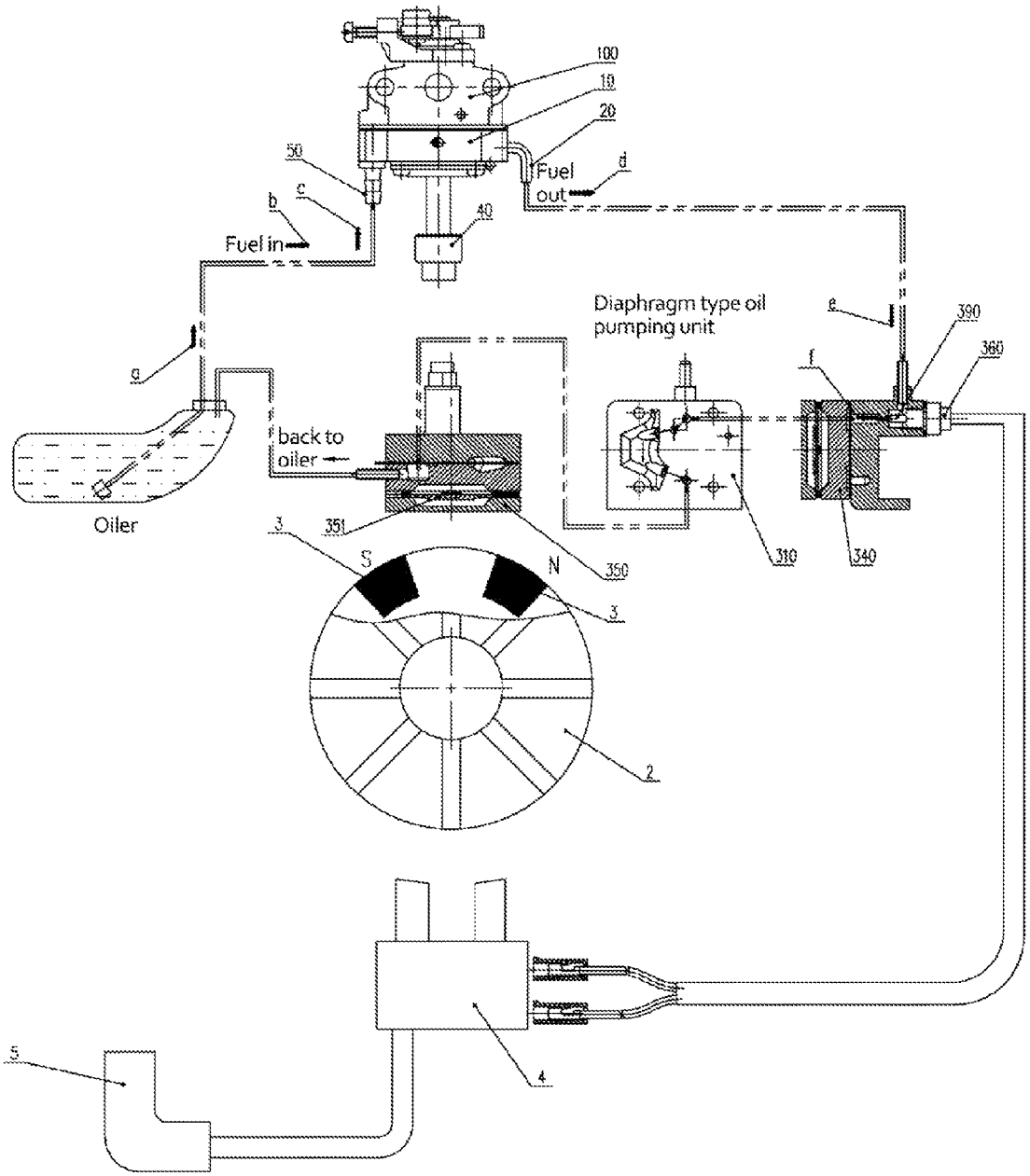
FIG. 4 is a structural schematic diagram of the combination of the diaphragm type oil pumping unit and the carburetor in FIG. 1.
Figure 5:
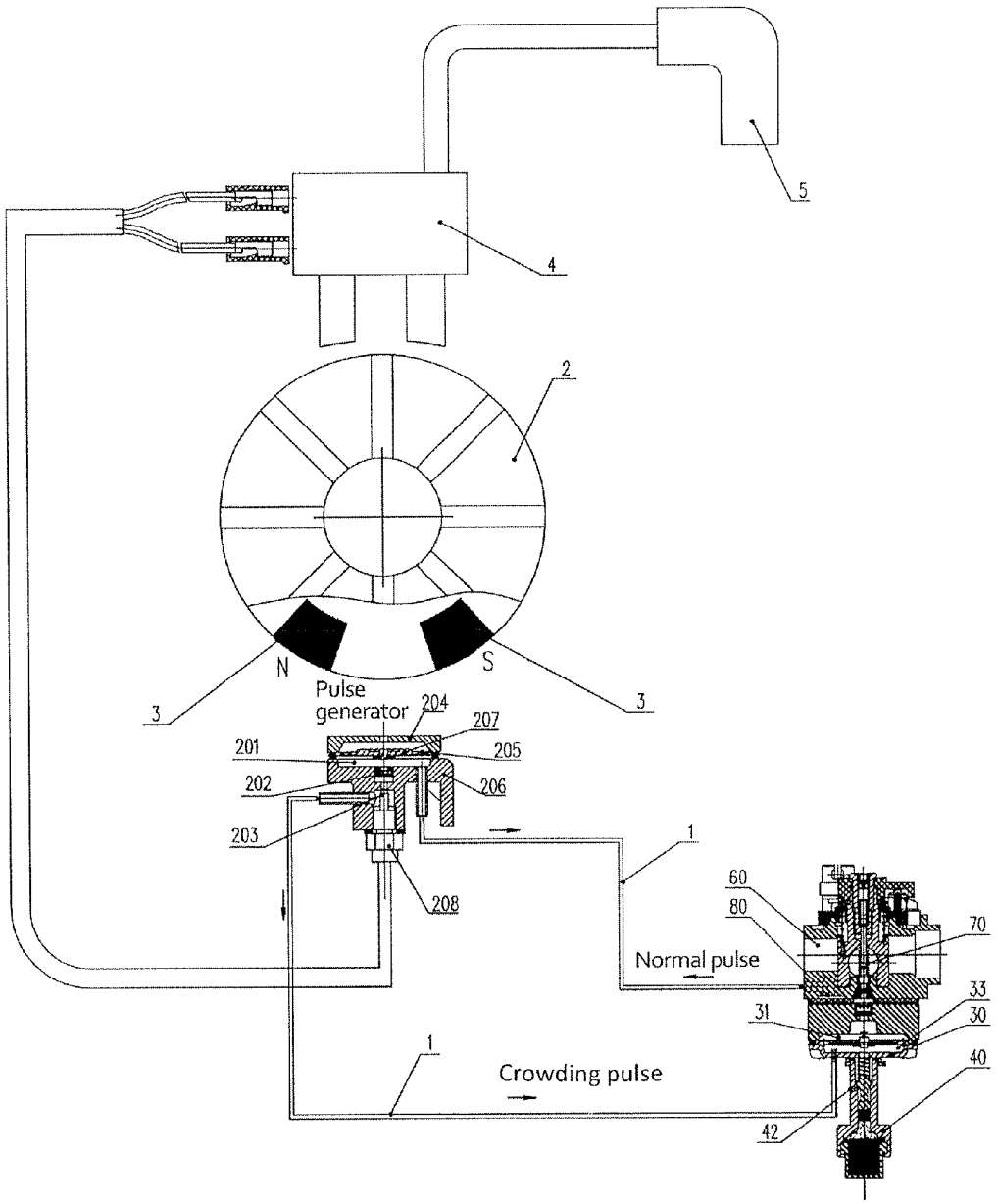
FIG. 5 is a structural schematic diagram of the combination of the pulse generator and the carburetor in FIG. 1.
Figure 7:
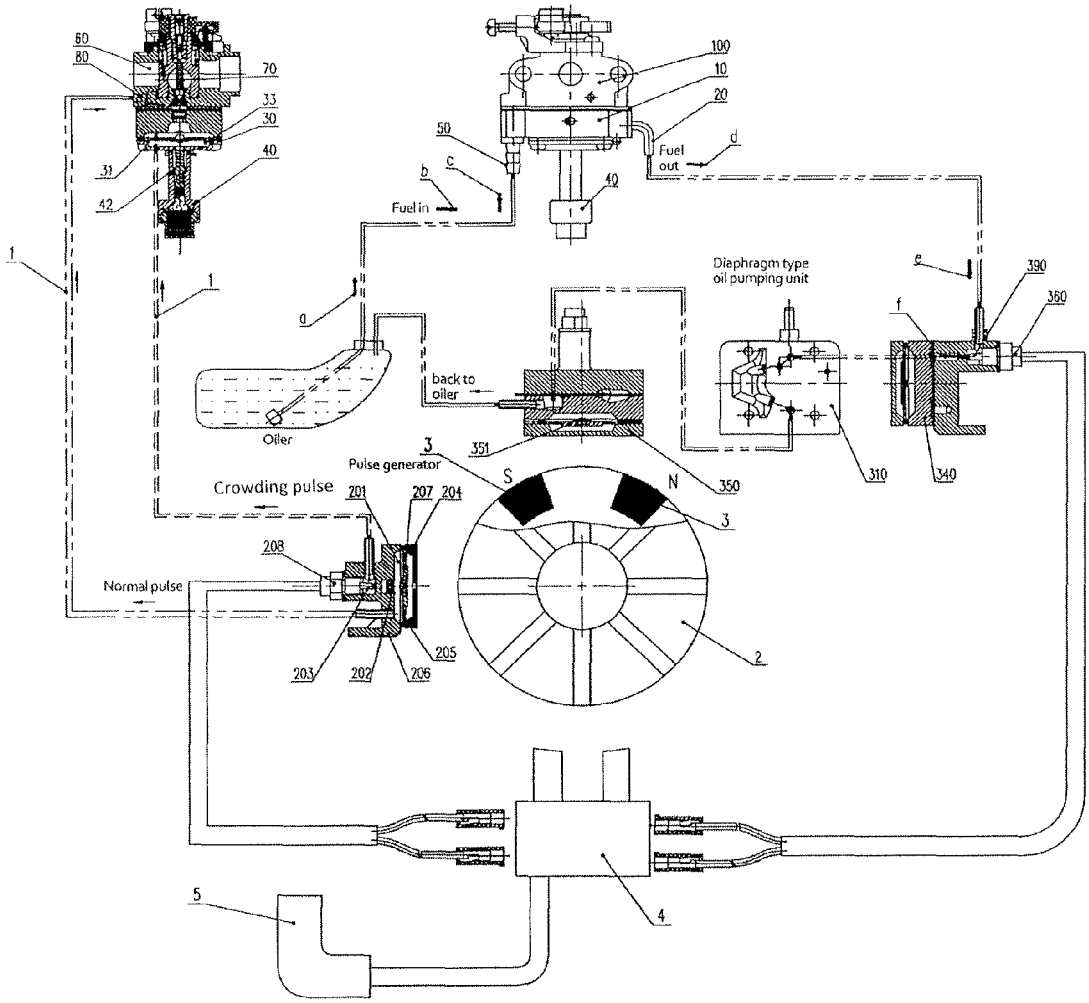
FIG. 7 is a structural schematic diagram of the combination of the pulse generator, the diaphragm type oil pumping unit and the carburetor in FIG. 1.
Figure 8:
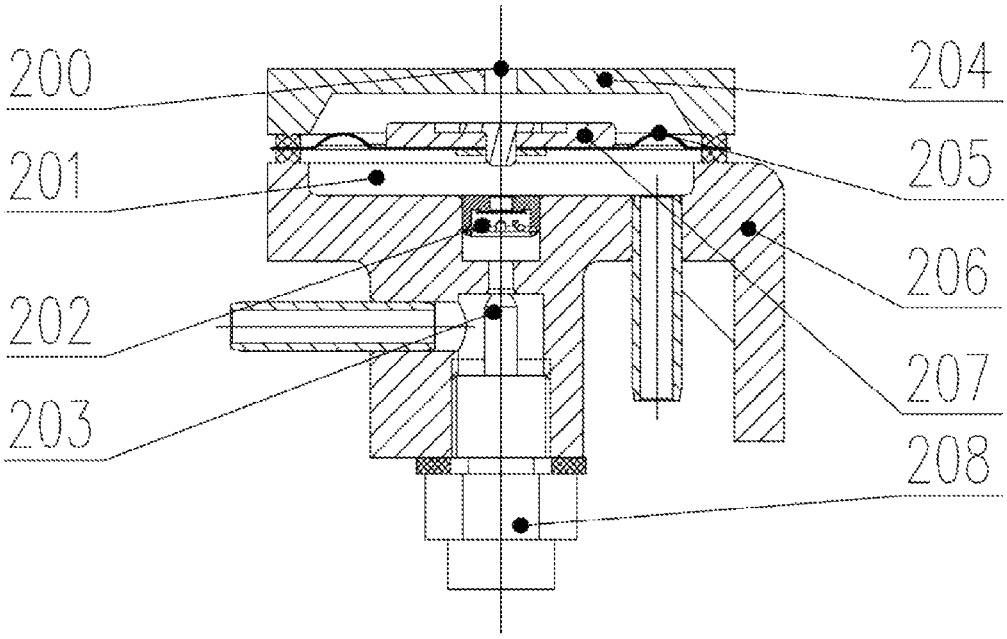
FIG. 8 is a sectional view of the pulse generator in FIG. 5.

Turning to FIGS. 4 and 7, the working process of the diaphragm type oil pumping unit 300 herein is described in detail. When the engine is starting, the flywheel 2 of the engine revolves. The magnets 3 of the flywheel 2 and the magnet 351 of the diaphragm part 343 attract or repel each other to lead the diaphragm part 343 of the diaphragm type oil pumping unit 300 to move up and down. When the diaphragm part 343 moves up and down, the pulse chamber F will inhale and exhale. The pulse is introduced from the pulse chamber F to the pulse chamber E through the hole 346 of the middle body 340. The inhalation and exhalation pulse are constantly produced in the pulse chamber E. Due to the effect of the pulses on the oil pumping diaphragm 320, the oil pumping diaphragm 320 puts such pulse force in the chamber 312 of the support 310 repeatedly.

When the pulse in the pulse chamber E is an inhalation pulse, because of the effect of the inhalation pulse force, the tongue piece D of the oil pumping diaphragm 320 seals the plane B of the support 310. And another tongue piece C of the oil pumping diaphragm 320 is open by the suction force. At this time the tongue piece C leaves the plane A of the support 310.

When the pulse in the chamber pulse chamber E is an exhalation pulse, the exhalation pulse force would have an effect on the oil pumping diaphragm 320. The blowing force could be produced in the chamber 312 on the support 310. The tongue piece D on the oil pumping diaphragm 320 is opened by this blowing force. The tongue piece D does not seal the plane B of the support 310. Another tongue piece C of the oil pumping diaphragm 320 is opened by the blowing force. At this time the tongue piece C seals the plane A of the support 310. The suction force could be produced in the fuel inlet pipe 370 after repeating the procedure. The fuel in the oiler can be through pipe lines according to the order of a, b and c and flows into the main body of the carburetor 100 by the fuel inlet pipe 50 under the action of such suction force. Then the redundant fuel flows into the diaphragm type oil pumping unit 300 by pipe lines according to the order of d and e. At last the redundant fuel flows into the oiler.

Further according to the FIG. 7, FIG. 7 is a structural diagram of a combination of the pulse generator 200, the diaphragm type oil pumping unit 300 and the carburetor 100 herein. Turning to FIGS. 2 and 7, the working process of the carburetor 100 which is connected with the pulse generator 200 and the diaphragm type oil pumping unit 300 herein is described in detail.

When the engine is starting, the flywheel 2 of the engine revolves. The magnets 3 of the flywheel 2 and the magnet 351 of the diaphragm part 343 attract or repel each other to lead the diaphragm part 343 of the diaphragm type oil pumping unit 300 to move up and down. When the diaphragm part 343 moves up and down, the pulse chamber 341 will inhale and exhale.

When the pulse in the pulse chamber E is an inhalation pulse, because of the effect of the inhalation pulse force, the tongue piece D of the oil pumping diaphragm 320 seals the plane B of the support 310. Another tongue piece C of the oil pumping diaphragm 320 is opened by the suction force. At this time the tongue piece C leaves the plane A of the support 310. When the pulse in the pulse chamber E is an exhalation pulse, the exhalation pulse force would have an effect on the oil pumping diaphragm 320. The blowing force could be produced in the chamber 312 on the support 310. The tongue piece D on the oil pumping diaphragm 320 is opened by the blowing force. The tongue piece D does not seal the plane B of the support 310. Another tongue piece C of the oil pumping diaphragm 320 seals the plane A of the support 310 by the blowing force. The suction force could be produced in the fuel inlet pipe 370 after repeating the procedure. The fuel in the oiler can be through pipe lines according to the order of a, b and c and flows into the main body of the carburetor 100 by the fuel inlet pipe 50 under the action of such suction force. Then the redundant fuel flows into the diaphragm type oil pumping unit 300 by pipe lines according to the order of d and e. At last the redundant fuel flows into the oiler.

When the engine starts at low temperature, to be precise the environment temperature is lower than 20° C. The air vent 42 on the temperature controller 40 is in a closed state. The pulse is produced in the pulse generating chamber 201 of the pulse generator 200. A part of the crowding pulse is into the chamber 33 of the lower cover of the metering chamber 31 of the carburetor 100. The metering diaphragm 32 is pushed by such crowding pulse, and the fuel in the metering chamber 31 which flows from the diaphragm type oil pumping unit 300 is squeezed into the main nozzle 70. The fuel-air mixture in the mixing chamber 60 is concentrated. Thus the engine would start easily. The other part of normal pulse goes into the pulse chamber 80 of the carburetor 100 to provide the pumping power for the normal work of the carburetor 100. After the engine starts and runs after 3-5 seconds, the crowding pulse is cut off by the solenoid valve 208. The crowding pulse could not enter into the chamber 33 of the lower cover of the metering chamber 31 of the carburetor 100, and the fuel-air mixture in the mixing chamber 60 could not be concentrated. Thus the normal work of the carburetor 100 would not be affected.

When the environment temperature is higher than 38° C., the air vent 42 on the temperature controller 40 is in an open state. Even though the crowding pulse was into the chamber 33 of the lower cover of the metering chamber 31 of the carburetor 100 after the engine starting, the crowding pulse would be discharged to the outside of the lower cover 30 of the carburetor 100 through the air vent 42 on the temperature controller 40. The metering diaphragm 32 cannot be pushed by the pulse force. Thus the fuel-air mixture in the mixing chamber 60 in the carburetor 100 could not be concentrated. At high temperature the engine also does not need too thick fuel-air mixture but just to meet the requirement of the engine starting. The pulse produced by the pulse generator 200 goes into the pulse chamber 80 of the carburetor 100 through the normal pulse pipe to provide the pumping power for the normal work of the carburetor 100.

When the engine is running after 3-5 seconds or the engine rotational speed is faster than 2000 r/min after starting the engine, the energized solenoid valve 360 of the diaphragm type oil pumping unit 300 is opened by a CPU control system of an igniter. The valve 390 in front of the solenoid valve is closed. At this time the oil circuit on the diaphragm type oil pumping unit 300 would be closed. Even if the diaphragm 343 on the diaphragm type oil pumping unit still moved up and down, the diaphragm type oil pumping unit 300 cannot pump fuel from the carburetor 100. Thus it could not affect the carburetor 100 normally work.

Although the figures disclosed the present invention in detail, it should be understood that these examples are, however, not used to limit the scope of applications of the present invention. The scope of the present invention is limited by additional claims. The scope also includes various variations, modifications and equivalent arrangements based on the present invention without departing from the scope and spirit of the present invention.

The invention claimed is:

1. A one-step starting carburetor system, comprising:

a body, a middle body, a fuel inlet pipe, a fuel outlet pipe, a lower cover and a temperature controller which is connected with the lower cover, wherein the fuel inlet pipe pumps fuel from an oiler through a pipe;

the fuel outlet pipe connects with an oil pumping unit through a pipe;

the body connects with a pulse generator through a pipe, wherein the pulse generator comprises a pulse generating chamber, a cover, and a solenoid valve; and wherein the temperature controller includes a copper base in which a paraffin is disposed, a diaphragm disposed between a fluid medium and the paraffin, a plunger slidable in a hollow chamber, a top pole comprised of an elongate part having a diameter less than the hollow chamber so that air from an air vent can enter the hollow chamber, and a return spring to bias the top pole to a position where air flow through the air vent is closed off.

2. The carburetor of claim 1, wherein the body includes a pulse chamber, a main nozzle and a mixing chamber.

3. The carburetor of claim 1, wherein the middle body includes a lower cover, a metering chamber and a metering diaphragm which is in the metering chamber.

4. The carburetor of claim 1, wherein the oil pumping unit is a valve structure oil pumping unit or a diaphragm type oil pumping unit.

5. The carburetor of claim 4, wherein the valve structure oil pumping unit includes a magnet.

6. The carburetor of claim 5, wherein the oil pumping unit and the pulse generator are both put up along a magneto of an engine, a flywheel is put up on the magneto, the flywheel has magnets and the pulse generator has a magnet, the magnets of the flywheel and the magnet of the pulse generator attract or repel each other when the flywheel is operating, and the magnets of the flywheel and the magnet of the valve structure oil pumping unit attract or repel each other when the flywheel is operating.

7. The carburetor of claim 6, wherein when the magnets of the flywheel and the magnet of the valve structure oil pumping unit attract each other, an inhalation pulse is generated by an oil pumping chamber and an umbrella shaped surface A of a valve core departs a plane of support to inhale fuel from the oiler to the carburetor.

8. The carburetor of claim 6, wherein an exhalation pulse is generated by an oil pumping chamber when the magnets of the flywheel repel the magnet of the valve structure oil pumping unit, and an umbrella shaped surface A of a valve core fits and seals with a support plane, and the fuel in an oil pumping chamber cannot return to the carburetor through a valve and the valve core plays a role of a one-way valve, and the fuel flows back to the oiler through a valve B.

9. The carburetor of claim 4, wherein the diaphragm type oil pumping unit includes a magnet.

10. The carburetor of claim 9, wherein the oil pumping unit and the pulse generator are both put up along a magneto of an engine, a flywheel is put up on the magneto, a pulse chamber of the pulse generator inhales and exhales when the flywheel is operating, the flywheel has magnets, and the magnets of the flywheel and the magnet of the diaphragm type oil pumping unit attract or repel each other when the flywheel is operating.

11. The carburetor of claim 10, wherein a chamber on a support of the diaphragm type oil pumping unit inhales when the magnets of the flywheel and the magnet of the diaphragm type oil pumping unit attract each other.

12. The carburetor of claim 10, wherein a chamber on a support of the diaphragm type oil pumping unit exhales when the magnets of the flywheel and the magnet of the diaphragm type oil pumping unit repel each other.

13. The carburetor of claim 10, wherein due to an inhalation pulse and an exhalation pulse generated by the magnets of the flywheel and the magnet of the diaphragm type oil pumping unit, suction is produced in the diaphragm type oil pumping unit under repeated application of the inhalation pulses and the exhalation pulses, and the fuel in the oiler is pumped into the carburetor through the pipe from the oiler by suction, and then redundant fuel in the carburetor flows back to the oiler through the pipe from the fuel outlet pipe.

14. The carburetor of claim 1 wherein a pulse chamber of the pulse generator inhales and exhales when the flywheel is operating.

15. The carburetor of claim 14, wherein two magnets are put up on the flywheel, N pole of one magnet is outward and S pole of another magnet is outward.

16. The carburetor of claim 1, wherein a magnet is put up on the pulse generator.

17. The carburetor of claim 14, wherein the flywheel has magnets and the pulse generator has a magnet, and wherein the magnets of the flywheel and the magnet of the pulse generator attract or repel each other when the flywheel is operating.

18. The carburetor of claim 17, wherein the pulse generating chamber inhales when the magnets of the flywheel and the magnet of the pulse generator attract each other.

19. The carburetor of claim 17, wherein the pulse generating chamber exhales when the magnets of the flywheel and the magnet of the pulse generator repel each other.

20. The carburetor of claim 18, wherein an inhalation pulse and an exhalation pulse are generated by the magnets of the flywheel and the magnet of the pulse generator, a part of air enters into the pulse chamber of the carburetor through a normal pulse pipe, then pumping force is generated by a diaphragm of the pulse chamber to pump the fuel from an oiler to the carburetor to provide continuous fuel for the carburetor.

21. A one-step starting carburetor system, comprising:

a body, a middle body, a fuel inlet pipe, a fuel outlet pipe, a lower cover and a temperature controller which is connected with the lower cover, wherein the fuel inlet pipe pumps fuel from an oiler through a pipe;

the fuel outlet pipe connects with an oil pumping unit through a pipe;

the body connects with a pulse generator through a pipe, wherein the pulse generator comprises a pulse generating chamber, a cover, and a solenoid valve;

wherein the oil pumping unit and the pulse generator are both put up along a magneto of an engine;

wherein a flywheel is put up on the magneto, and a pulse chamber of the pulse generator inhales and exhales when the flywheel is operating;

wherein the flywheel has magnets and the pulse generator has a magnet, and wherein the magnets of the flywheel and the magnet of the pulse generator attract or repel each other when the flywheel is operating;

wherein the pulse generating chamber inhales when the magnets of the flywheel and the magnet of the pulse generator attract each other;

wherein an inhalation pulse and an exhalation pulse generated by the magnets of the flywheel and the magnet of the pulse generator, only the exhalation pulse can enter into a chamber of the lower cover of the carburetor through a crowding pipe due to a one-way valve; more fuel is sprayed out from the main nozzle of the carburetor by pushing a metering diaphragm when a solenoid valve is open, and mixed gas is concentrated in a mixing chamber to start the engine easily; and wherein the temperature controller includes a copper base in which a paraffin is disposed, a diaphragm disposed between a fluid medium and the paraffin, a plunger slidable in a hollow chamber, a top pole comprised of an elongate part having a diameter less than the hollow chamber so that air from an air vent can enter the hollow chamber, and a return spring to bias the top pole to a position where air flow through the air vent is closed off.

* * * * *